US005361538A

United States Patent [19]

McNabb

[11] Patent Number: 5,361,538

[45] Date of Patent: Nov. 8, 1994

[54] GATE FOR CHECK-OUT LANE

[75] Inventor: James H. McNabb, Decatur, Ga.

[73] Assignee: Abrams Fixture Corporation, Atlanta, Ga.

[21] Appl. No.: 50,871

[22] Filed: Apr. 20, 1993

[51] Int. Cl.[5] ..... E05D 15/52

[52] U.S. Cl. ..... 49/192; 49/390

[58] Field of Search ..... 49/57, 192, 193, 390, 49/50

[56] References Cited

U.S. PATENT DOCUMENTS

| | | | |
|---|---|---|---|
| 420,541 | 2/1890 | Mallory | 49/193 |
| 594,822 | 11/1897 | Bolton | 49/193 |
| 1,728,040 | 9/1929 | Carl | 49/192 |
| 3,676,955 | 7/1972 | Schacht | 49/390 |
| 4,569,092 | 2/1986 | Baus | 49/501 |
| 4,611,431 | 9/1986 | Lauro | 49/57 |
| 4,702,036 | 10/1987 | Johnson | 49/57 |
| 5,117,585 | 6/1992 | Andrisin, III | 49/57 |

*Primary Examiner*—Michael J. Milano
*Attorney, Agent, or Firm*—Needle & Rosenberg

[57] ABSTRACT

A gate for a check-out aisle, which displays point-of-purchase merchandise when the gate is in both open and closed positions. The gate has an outer frame that is hingedly mounted along one edge to an edge of the check-out counter, enabling the gate to swing open adjacent to the check-out aisle, or closed across the check-out aisle. An inner frame comprising a lattice face for hanging the point-of-purchase merchandise is pivotally mounted to the outer frame so that the inner frame will rotate about a vertical axis within the outer frame in order to display the merchandise to customers when the gate is both open and closed. The second embodiment provides for a pair of such gates which are hingedly mounted adjacent respective check-out counters so that they can be moved to lie across a double check-out lane that is between the counters.

10 Claims, 5 Drawing Sheets

GATE FOR CHECK-OUT LANE

BACKGROUND OF THE INVENTION

This invention relates to a gate for a check-out aisle of a retail or wholesale establishment and, more particularly, to a check-out gate on which can be displayed merchandise when the gate is in its open and closed positions.

Everyone is familiar with going into a grocery store and finding one or more of the unused check-out lanes closed off by various means, such as a chain or a grocery cart. The disadvantages of these barricade means include that they are cumbersome, unsightly, and make inaccessible the point-of-purchase merchandise associated with that aisle or lane. Thus, a convenient means is needed both to close off check-out aisles when required as well as to provide a selling area which will display merchandise when the aisle is opened or closed.

SUMMARY OF THE INVENTION

The above disadvantages of the prior art are overcome by the present invention which comprises a check-out gate with a rotating grid that can close off the check-out aisles when needed and display merchandise when the gate is in the open or closed position.

The gate includes an outer, rectangular frame that is mounted along one of its sides about a vertical axis to an edge of the check-out counter. The bottom of the outer frame is provided with a lockable swivel caster which rides along the floor. The gate is movable between a closed position across the check-out lane or an open position substantially parallel and adjacent to the check-out counter.

An inner frame is mounted within the outer frame to revolve about its center along a vertical axis. A vertically oriented grid on the inner frame provides a display face on which point-of-purchase merchandise may be exhibited. The inner frame is rotated 180° between the open and closed positions so as to always present the display face with the merchandise thereon to the consumer. The merchandise can be rotated on the inner frame without falling off of the grid.

A latch provides a means for securing the inner frame within the outer frame after it has been rotated. One side of the outer frame is rotably connected to the check-out counter by means of offset hinges which allows the gate to be recessed when in its open position while maintaining the displayed merchandise out of the path of travel of the check-out customers.

Another embodiment of the present invention comprises a pair of gates which are hingedly connected to each side of a double check-out lane along the opposed sides of the gates. Each of the gates includes an inner frame rotably mounted about a respective vertical axis to present to the customer a display face in the open position and the same display face in the closed position wherein the gates are laterally disposed across the check-out lane. The construction of each of the gates in the double-gate embodiment is identical to that described in the single-gate embodiment. A latch pivotally mounted on one of the gates about a horizontal axis is movable between a locked position wherein the latch engages the other gate to prevent the gates from being inadvertently moved to their open positions and an unlocked position whereby the gates can be swung to their respective open position.

The third embodiment comprises a hinge means that allows the gate to be disposed, when opened, in a number of positions to accommodate merchandise that may be located adjacent to the check-out counter.

BRIEF DESCRIPTION OF THE FIGURES OF DRAWINGS

DETAILED DESCRIPTION OF THE PREFERRED EMBODIMENTS

Figure 1:
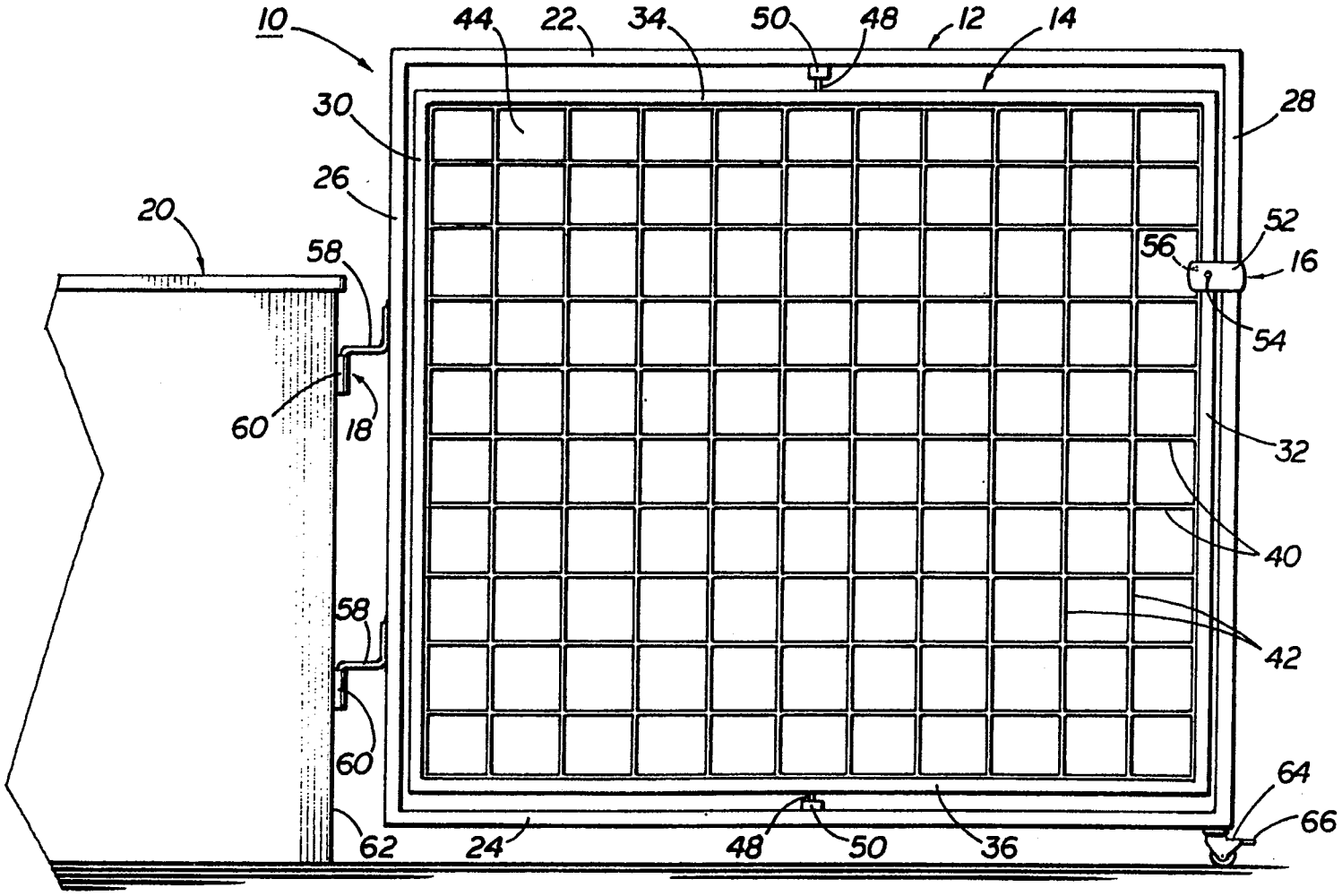
FIG. 1 is a front view showing the gate of the first embodiment of the present invention in its closed position across a lane of a check-out counter.

Referring to FIG. 1, the first embodiment check-out lane gate 10 of the present invention comprises an outer frame 12, an inner frame 14 mounted for vertical rotation about its center within the outer frame 12, locking means 16 for securing the position of the inner frame 14 with respect to the outer frame 12, and hinge means 18 by which the gate 10 is rotably attached to the check-out counter 20.

Figure 2:
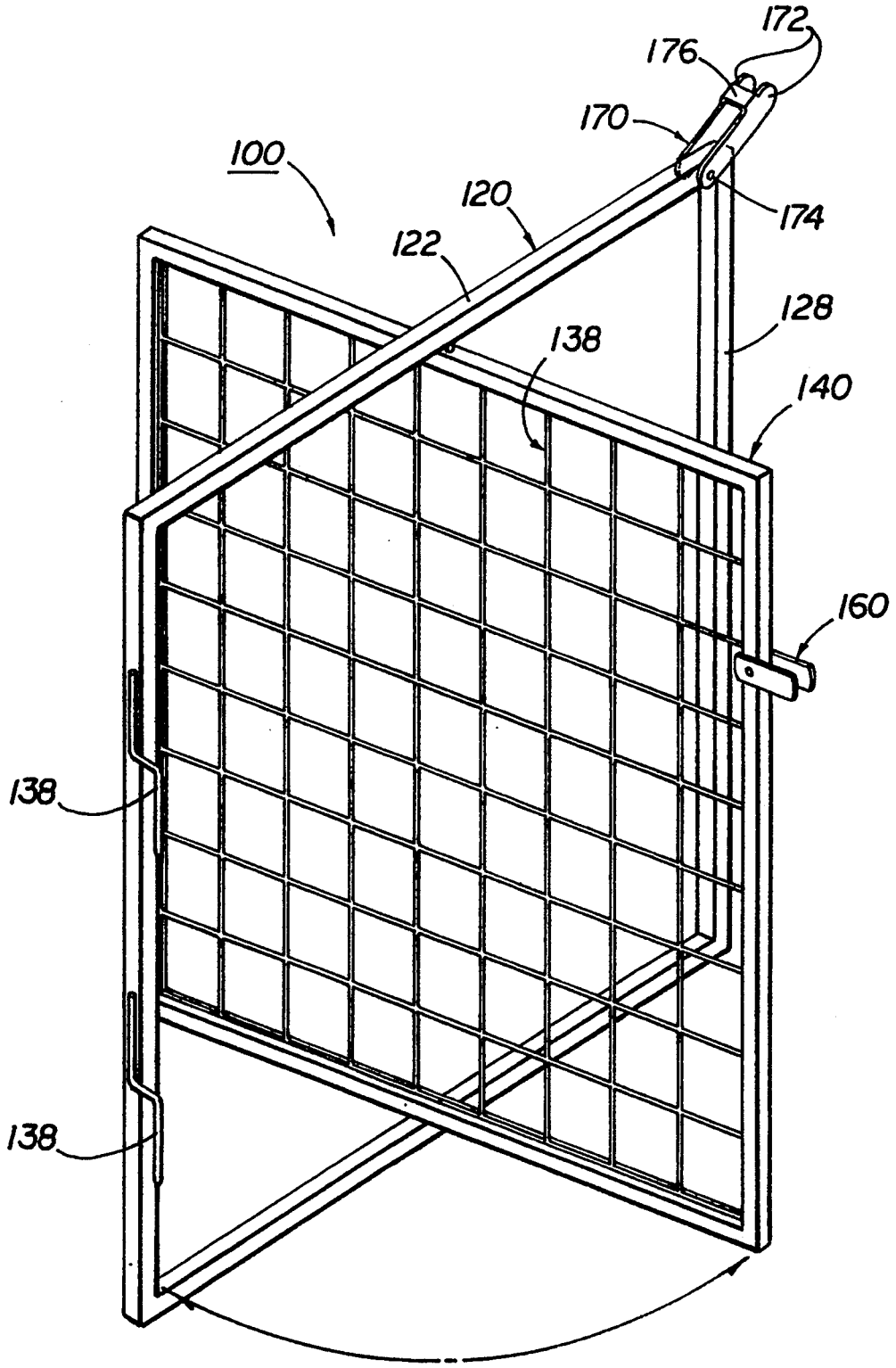
FIG. 2 is a perspective view of the gate of the second embodiment with the inner frame rotated within the outer frame.
Figure 3:
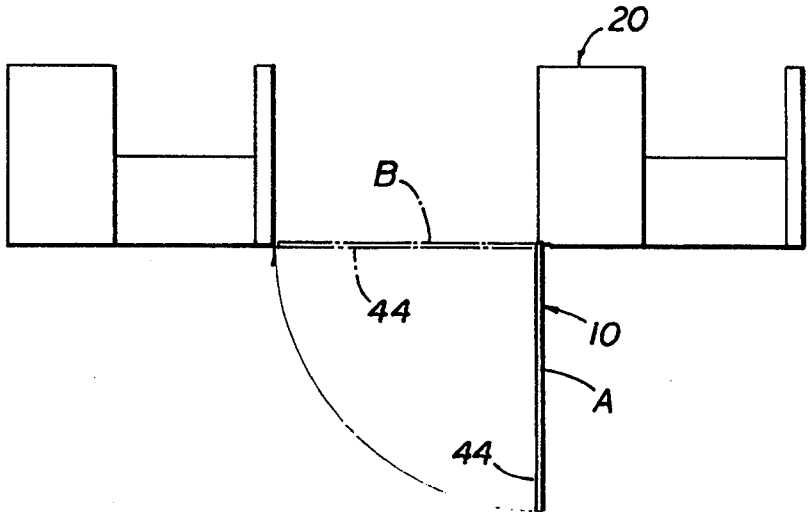
FIG. 3 is a top plan view of the gate of the first embodiment.

Referring to FIGS. 1 and 2, the outer frame 12 is a rectangle having a top bar 22, an opposed bottom bar 24, and vertically disposed left and right side bars 26, 28. The inner frame 14 is disposed within the outer frame 12 and comprises vertically opposed left and right side bars 30, 32 which interconnect with opposed horizontal top and bottom bars 34, 36. A vertical lattice or grid 38 is secured within the inner frame 14 and comprises a plurality of spaced, parallel horizontal rods 40 and spaced, parallel vertical rods 42. The grid 38 provides a first face 44 for hanging thereon point-of-purchase merchandise (not shown). The function of the present invention is to always present the face 44 to the customer, regardless of whether the gate 10, as seen in FIG. 3, is in an open position (A), or a closed position (B) across the check-out lane.

The inner frame 14 is rotably mounted within the outer frame 12 by means of a pair of pins 48 vertically disposed on bars 34, 36 which are received within bushings 50 secured to the bars 22, 24.

The locking means 16 comprises two elongated plates 52 attached to each other by a bolt 54 which passes through right side bar 32 of the inner frame 14, and a pin 56 secured on the right side bar 28 that prevents further downward rotation of the plates 52 about the axis of bolt 54.

The hinge means 18 includes a pair of Z-shaped pins 58 that are secured along one leg to the left bar 26, with the depending legs rotably received within plates 60 that are mounted on the sidewall 62 of the counter 20. The hinge means 18 is of an off-set construction to allow the gate 10 to be as close as possible to the sidewall 62 of the counter 20 when the gate 10 is in its position (B). A caster 64 mounted on the underside of bottom bar 24 adjacent its juncture with right side bar 28 aids in the gate 10 swinging between its open (A) and closed (B) positions. A locking means 66 secures the caster 64 when the gate 10 is at rest.

In its operation, various types of merchandise may be arranged on the grid 38 along the face 44. With the gate 10 in its open position (A) adjacent the counter 20, customers are allowed to enter the check-out lane to pay for the items they wish to purchase. The merchandise arrayed on gate 10 allows them to make last-minute, impulse-type purchases.

When it is desired to close the lane to customer traffic, the locking means 66 is unlocked and the gate 10 is swung approximately 90° about hinge means 18 to its closed position (B) laterally extending across the check-out lane. The locking means 66 are then engaged, again, to secure the gate 10 in the desired position. The plates 52 are moved inwardly about bolt 54 so that the inner frame 14 may be rotated 180° about pins 48 to present again face 44 and the merchandise (not shown) thereon to the customers who pass by that check-out lane. When the face 44 is positioned correctly, the plates 52 are moved downward until they engage pin 56, thereby locking the inner frame 14 within the outer frame 12.

Figure 4:
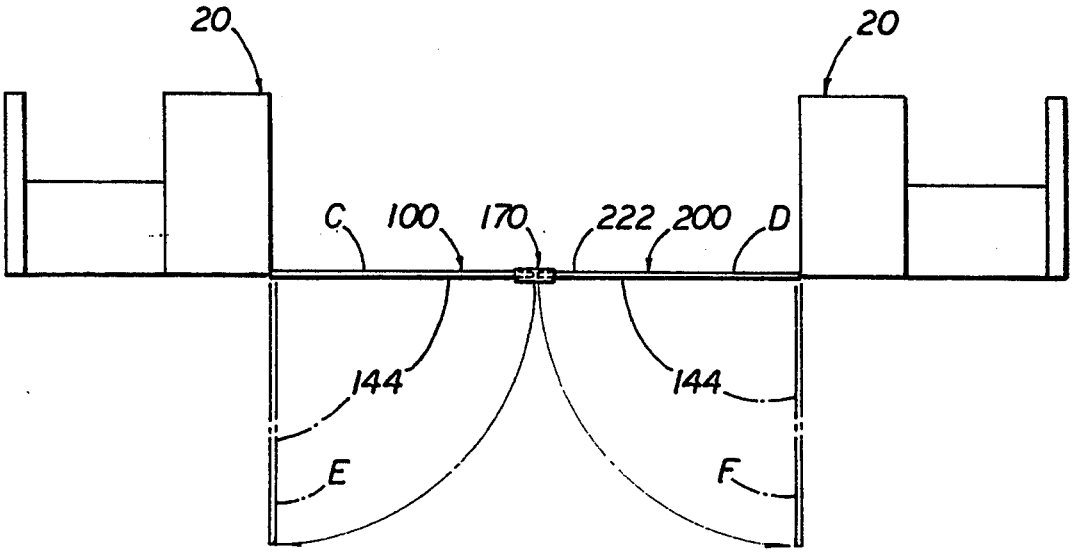
FIG. 4 is a top plan view of the second embodiment of the gate utilized in a double check-out lane.
Figure 5:
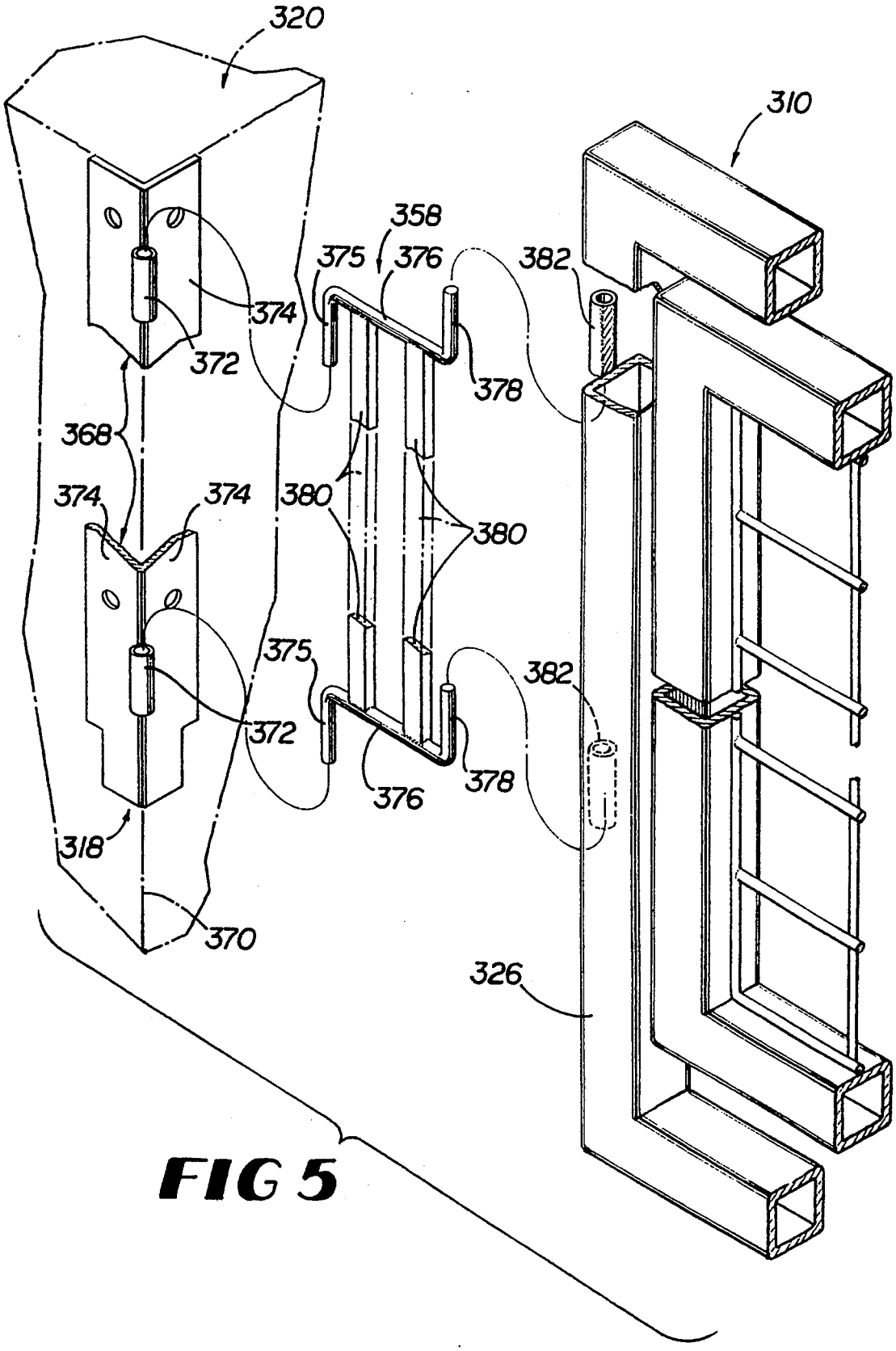
FIG. 5 is a partial exploded perspective view of the hinge of the third embodiment of the present invention.

The second embodiment of the present invention is shown in FIGS. 2 and 4 and comprises a pair of gates 100, 200. Each of the gates 100, 200 have a construction which is identical to gate 10, including outer frames 120, inner frame 140 which is rotably mounted therein, grid 138, and locking means 160.

A new element for the second embodiment includes a latch means 170 that fastens the gates 100, 200 together when they are in their respective closed positions (C), (D), as seen in FIG. 4. The latch means 170 comprises a pair of elongated elements 172 that are mounted about one of their ends for pivotal movement by means of pin 174 through top bar 122 adjacent its juncture with side bar 128. A cross-bar 176 joins elements 172 across their tops near their distal ends. When the gates 100, 200 assume their positions (C), (D), the latch means 170 is rotated downwardly until the cross-bar 176 engages the top bar 222 of gate 200.

Again referring to FIG. 4, the gates 100, 200 are shown to allow swinging them to their respective open positions (E), (F). The inner frames 140 would then each be rotated 180° to allow their respective face 144 to be substantially parallel to the longitudinal axis of the lane.

FIGS. 5–9 disclose the third embodiment of the present invention featuring an offset hinge means 318 including a 90° angle element 368 which is bolted to the corner 370 of the counter 320. A pair of cylindrical sleeves 372 are secured in vertical alignment along the juncture of the flat plates 374 which comprise the element 368. Top of the elements 368 having a sleeve 372 thereon are usually spaced along the corner 370.

The sleeves 372 receive the depending legs 375 of the Z-shaped pins 358 which further include a horizontal portion 376 that terminates in upwardly extending portion 378. The pins 358 are joined together by means of the elongated braces 380 which are secured to the underside of the horizontal portions 376. The upwardly extending portions 378 are received within sleeves 382 that are spaced along the left bar 326 of the gate 310.

Figure 6:
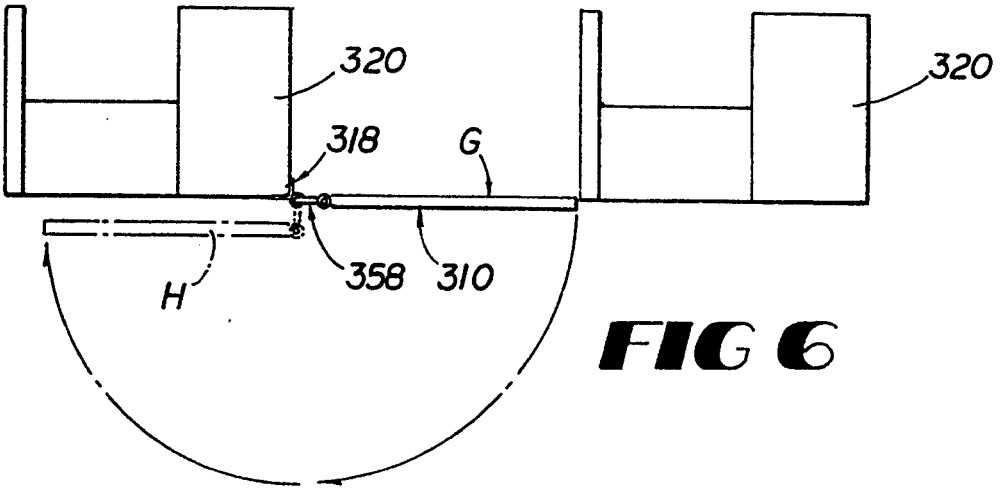
FIGS. 6–9 are top plan views of the third embodiment with the gate in its various positions.
Figure 7:
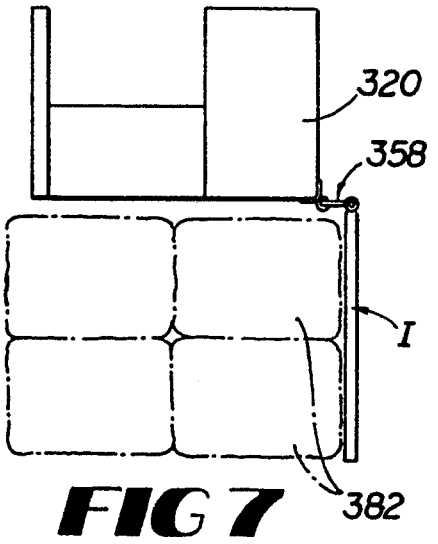
Figure 9:
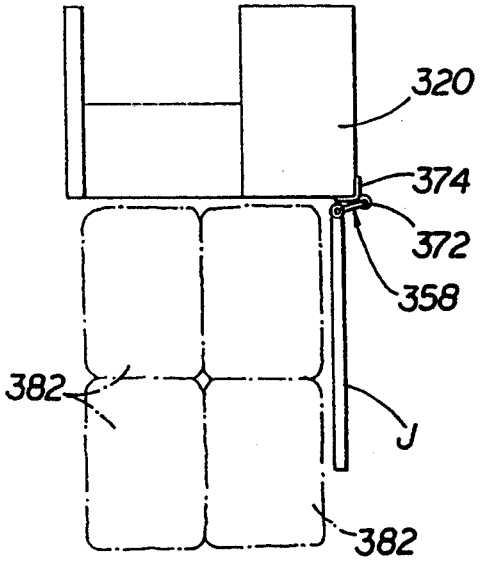
Figure 8:
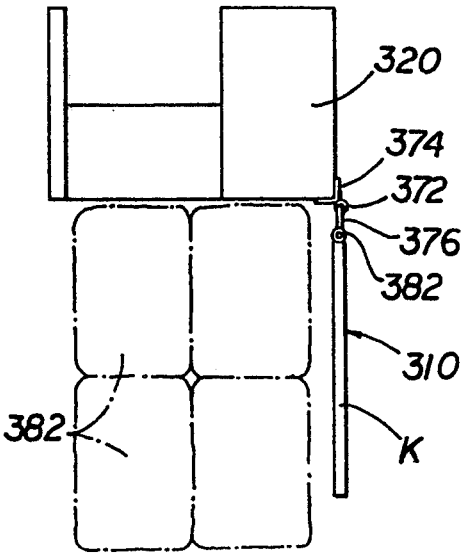

FIG. 6 discloses the gate 310 in its closed position G and its open position H wherein it is substantially parallel to the front of the counter 320. FIG. 7 depicts a display of products 382 which extend into the path of travel of the lane of the of the check-out counter 320. The hinge means 318 allows the gate 310 to be positioned at I which is parallel to, but not in the same plane as, the side of the counter 320. In FIG. 9, the gate 310 is in its open position J which is out of the path of the check-out lane but inside the plane of the side of the counter 320. Thus, the gate 310 is in a recessed position with respect to the counter 320, which keeps the merchandise displayed on the inner frame outside of the check-out aisle. FIG. 8 discloses the gate 320 in an open position K wherein the hinge means 318 is adjusted to dispose the gate 310 substantially in alignment with the plane of the side of counter 320.

Figure 10:
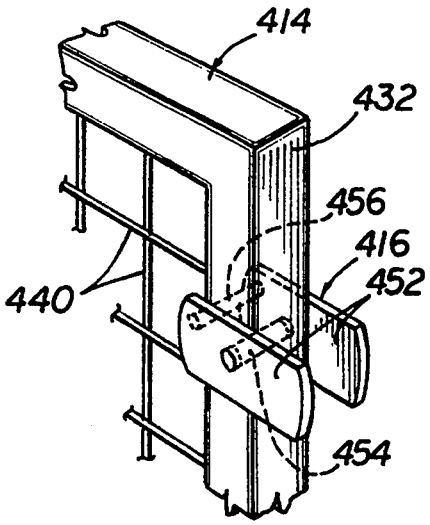
FIG. 10 is a partial perspective view of another embodiment of the gate locking means.

In FIG. 10, the second embodiment of the locking means 416 is disclosed for securing the position of the inner frame 414 with its rods 440 with respect to the outer frame (not shown). The locking means 416 comprises two elongated plates 452 which are on each side of right side bar 432 and which are secured to each other by means of bolt 454 that passes through substantially the middle of the bar 432. Pin 456 passes through and joins together the rear portions of the plates 452. The longitudinal axis of pin 456 is higher than the pivoting axis of bolt 454. So that pin 456 engages the rear surface of side bar 432 and prevents further downward movement of the plates 452 about bolt 454 as they engage therebetween the outer frame in the locked position. When it is desired to pivot the inner frame 414 about its vertical axis, the plates 452 are moved upwardly until the pin 456 again contacts the rear surface of side bar 432, stopping any further upward movement of the plates 452. The plates 452 are then in their unlocked or open position.

What is claimed is:

1. A gate for a lane adjacent a store check-out counter, comprising:

a. an outer frame;

b. means for moving the outer frame between a closed position laterally disposed across the lane and an open position adjacent a side of the lane;

c. an inner frame rotably mounted about a vertical axis within the outer frame and having a display face;

d. means for selectively securing the inner frame in a coplanar relationship within the outer frame so as to present the display face to customers in both the closed and open position; and e. the display face comprising at least one horizontal rod for displaying merchandise.

2. A gate as claimed in claim 1 wherein the outer frame comprises a top, an opposed parallel bottom, and opposed sides interconnecting the top and the bottom, and wherein the moving means comprises a hinge means interconnecting one of the sides of the outer frame to the counter whereby the outer frame is capable of being rotated about a vertical axis.

3. A gate as claimed in claim 2 wherein the outer and inner frames are rectangular in shape and wherein the inner frame is rotably mounted about its middle within the top and bottom of the outer frame.

4. A gate for a lane adjacent a store check-out counter, comprising:

a. an outer frame comprising a top, an opposed parallel bottom, and opposed sides interconnecting the top and the bottom;

b. an inner frame rotably mounted about a vertical axis within the outer frame and having a display face;

c. means for selectively securing the inner frame in a coplanar relationship within the outer frame so as to present the display face to customers in both the closed and open position;

d. means on the display face for displaying merchandise;

e. a wheel means mounted on the bottom of the outer frame which engages the floor; and f. means for moving the outer frame between a closed position laterally disposed across the lane and an open position adjacent a side of the lane, comprising a hinge means for interconnecting one of the sides of the outer frame to the counter whereby the outer frame is capable of being rotated about a vertical axis.

5. A gate as claimed in claim 4 and further comprising means for locking the wheel means when the outer frame is in the open position and when it is in the closed position.

6. A display for merchandise in a store having a pair of check-out counters adjacent each side of a double customer lane, comprising:

a. a pair of gates, each gate comprising an outer frame having opposed sides, a top and a bottom;

b. means for moving each gate in opposite directions between a closed position laterally disposed across each lane such that the longitudinal axes of the gates are in alignment and an open position adjacent a respective outer side of each lane;

c. an inner frame rotably mounted about a vertical axis within each of the outer frames and having a display face;

d. means for selectively securing the inner frame within the outer frame of each gate so as to present each display face to customers in both the closed and open position; and e. means on each display face for displaying merchandise.

7. A display as claimed in claim 6 wherein the moving means comprises a hinge means interconnecting about a vertical axis one of the opposed sides of each gate to a respective counter and wheel means on the bottom of each gate.

8. A display as claimed in claim 7 and further comprising means for securing the gates in their closed position.

9. A display as claimed in claim 8 wherein said securing means comprises a latch mounted on the opposed side of a gate which is opposite from the side having the hinge means thereon, the latch pivotally mounted about a horizontal axis between an unlocked position wherein the latch is pivoted to a vertical orientation and the gates are movable to their respective open positions and a locked position wherein the latch is pivoted to a horizontal orientation allowing engagement with the other gate in the closed position.

10. A method of displaying merchandise on a check-out lane gate comprising selecting merchandise for display and displaying the merchandise on a gate comprising:

a. an outer frame;

b. means for moving the outer frame between a closed position laterally disposed across the lane and an open position adjacent a side of the lane;

c. an inner frame rotably mounted about a vertical axis within the outer frame and having a display face;

d. means for selectively securing the inner frame in a coplanar relationship within the outer frame so as to present the display face to customers in both the closed and open position; and e. the display face comprising at least one horizontal rod for displaying merchandise.

* * * * *